US007023386B2

(12) United States Patent
Habib et al.

(10) Patent No.: US 7,023,386 B2
(45) Date of Patent: Apr. 4, 2006

(54) HIGH GAIN ANTENNA FOR MICROWAVE FREQUENCIES

(75) Inventors: Laurent Habib, Moshav Shapira (IL); Claude Samson, Rehovot (IL)

(73) Assignee: Elta Systems Ltd., Ashdod (IL)

( * ) Notice: Subject to any disclaimer, the term of this patent is extended or adjusted under 35 U.S.C. 154(b) by 0 days.

(21) Appl. No.: 10/800,019

(22) Filed: Mar. 15, 2004

(65) Prior Publication Data

US 2005/0200527 A1 Sep. 15, 2005

(51) Int. Cl.
*H01Q 1/38* (2006.01)

(52) U.S. Cl. ..... 343/700 MS; 343/850; 343/853

(58) Field of Classification Search ..... 343/795, 343/793, 806, 803, 810, 700 MS, 850, 853; H01Q 1/38
See application file for complete search history.

(56) References Cited

U.S. PATENT DOCUMENTS

| | | | | |
|---|---|---|---|---|
| 5,708,446 | A * | 1/1998 | Laramie | 343/815 |
| 5,786,793 | A | 7/1998 | Maeda et al. | |
| 6,037,911 | A * | 3/2000 | Brankovic et al. | 343/795 |
| 6,163,308 | A | 12/2000 | Nakamura et al. | |
| 6,166,702 | A * | 12/2000 | Audenaerde et al. | 343/795 |
| 6,275,192 | B1 | 8/2001 | Kim | |
| 6,285,323 | B1 | 9/2001 | Frank | |
| 6,424,311 | B1 * | 7/2002 | Tsai et al. | 343/795 |
| 6,518,935 | B1 | 2/2003 | Louzir et al. | |
| 6,844,851 | B1 * | 1/2005 | Yoon et al. | 343/700 MS |
| 2003/0020665 | A1 | 1/2003 | Shor | |
| 2003/0063031 | A1 | 4/2003 | Wong et al. | |
| 2003/0218571 | A1 | 11/2003 | Yoon et al. | |

FOREIGN PATENT DOCUMENTS

| | | | |
|---|---|---|---|
| EP | 0 920 074 | A1 | 6/1999 |
| EP | 1 271 692 | A1 | 1/2003 |
| WO | WO 01/80358 | A1 | 10/2001 |

OTHER PUBLICATIONS

Sasas Dragas and Marco Sabbadini; "A Novel Type of Wide Band Circular Polarised Antenna"; Proceedings ESA WPP-222;27th ESA Antenna Workshop on Innovative Periodic Antennas; Electromagnetic Bandgap, Lefthanded Material, Fractal and Frequency Selective Surfaces. Mar. 9-11, 2004, Santiago de Compostela.

* cited by examiner

*Primary Examiner*—Hoanganh Le
(74) *Attorney, Agent, or Firm*—Browdy and Neimark, PLLC

(57) ABSTRACT

A microwave antenna for transmitting and/or receiving electromagnetic waves of at least one predefined frequency and a predefined polarization, the antenna comprises a support with upper and lower faces; at least one pair of substantially identical upper and lower radiating elements disposed on said upper and lower faces; in each pair of said radiating element in the upper face and the corresponding radiating element in the lower face, the phase center of the lower radiating element substantially coincides with the phase center of the upper radiating element.

23 Claims, 9 Drawing Sheets

HIGH GAIN ANTENNA FOR MICROWAVE FREQUENCIES

FIELD OF THE INVENTION

This invention relates generally to the field of high-frequency antennas and particularly to the field of planar and conformal antennas for high frequency microwaves.

BACKGROUND OF THE INVENTION

Planar (or flat-plate) and conformal antennas for high frequency microwave transmission (e.g. in various parts of 0.1–40 GHz range) are nowadays widely in use for example, in radio broadcasting, mobile communication, and satellite communication. Such antennas can provide circular polarization and linear polarization, based on their specific configuration.

Generally, printed conformal and planar antennas are built on a multilayered substrate structure (e.g. PCB, printed circuit board) and include, inter alia, a dielectric substrate and an array of radiating elements and their respective transmission lines, the number of elements depending on their gain as well as on the overall desired gain of the antenna. The radiating elements and the transmission lines are disposed on either one or both sides of the dielectric substrate. Planar antennas are produced, for example, by printing, in the so-called "microstrip" technology or photolithography.

U.S. Pat. No. 6,285,323 discloses a flat panel antenna for microwave transmission that comprises at least one PCB, and has radiating elements and transmission lines located on both the first and second sides of the PCB in a complementary manner, such that the transmission lines of the first and second sides overlay one another, and the radiating elements of the second side extend outwards from the terminations of the transmission lines in the opposite directions, at an angle of 180 degrees from the radiating elements of the first side.

U.S. Patent application Ser. No. 2003/0218571 discloses an antenna having linear and circular polarization, which uses dipoles as radiating elements, and has an orthogonal characteristic in both linear and circular polarization, the antenna being embodied in the use of two plates, including the front and rear sides of both plates.

U.S. patent application Ser. No. 2003/0020665 discloses a planar antenna having a scalable multi-dipole structure for receiving and transmitting high-frequency signals, including a plurality of opposing layers of conducting strips disposed on either side of an insulating (dielectric) substrate.

U.S. Pat. No. 6,163,306 discloses a circularly polarized cross dipole antenna comprising a first L-shaped dipole antenna element including a first pair of strip conductors and a first bending portion and a second L-shaped dipole antenna element including a second pair of strip conductors and a second bending portion. The first L-shaped dipole antenna element is arranged in a first region of four regions delimited by crossing lines virtually set within a single plane and the second L-shaped dipole antenna element is arranged in a second region thereof, which is diagonally opposite to the first region. The first bending portion and the second bending portion are close and opposite to each other, such that the first and second L-shaped dipole antenna elements form a cross. The antenna also comprises a parallel-twin-line feeder extended from the first and second bending portions and provided so as to feed power within the single plane.

U.S. Pat. Nos. 5,786,793 and 6,518,935 and U.S. patent application Ser. No. 2003/0063031 also relate to planar antennas.

There is a need in the art for a new planar/conformal antenna.

SUMMARY OF THE INVENTION

The present invention provides for planar and conformal antennas for transmitting and/or receiving electromagnetic waves of at least one predefined frequency in the range of 0.1–40 GHz, and a predefined polarization. The antenna according to the invention provides circular polarization, linear polarization, based on its specific predefined configuration.

According to an embodiment of the invention there is provided a planar or conformal antenna for transmitting and/or receiving electromagnetic waves of at least one predefined frequency and a predefined polarization, the antenna comprising a plane dielectric substrate (PCB) with upper and lower faces; at least one pair of substantially identical upper and lower radiating elements disposed on said upper and lower faces; in each pair of said radiating element in the upper face and the corresponding radiating element in the lower face, the phase center of the lower radiating element substantially coincides with the phase center of the upper radiating element. This allows for high level of antenna performance, e.g. gain of at least 1 dB, 1.5 dB and more, up to 3 dB, when compared to a prior art antenna with the same number of radiating elements, having substantially the same geometrical dimensions; and low axial ratio over large portion of the radiated beam.

According to an embodiment of the invention, the antenna is configured for providing circular polarization, and each of the radiating elements is capable of radiating electromagnetic waves of a circular polarization. According to another embodiment of the invention, the radiating elements comprise bend-shaped elements. According to yet another embodiment of the invention, the above-mentioned bend-shape is an L-shape.

According to an embodiment of the invention, the antenna is configured for providing linear polarization, and the radiating elements comprise radiating elements having first and second branches arranged in an acute angle with respect to each other.

According to an embodiment of the invention there is provided an antenna for transmitting and/or receiving electromagnetic waves of at least one predefined frequency and a predefined polarization, the antenna comprising a multilayered substrate structure having a dielectric substrate with upper and lower faces; at least one pair of substantially identical upper and lower radiating elements disposed on said upper and lower faces of the dielectric substrate; each radiating element transmitting and/or receiving electromagnetic waves with a phase center located at a predefined position; each radiating element comprising a radiating element and a transmission line, the geometrical dimensions of which depend on said predefined frequency; in each pair of said radiating element in the upper face and the corresponding radiating element in the lower face:

the transmission lines of the upper and lower elements overlay each other; and the radiating elements of the upper and lower elements are located oppositely to each other with respect to a plane perpendicular to the plane of the dielectric substrate, such that the phase center of the lower radiating element substantially coincides with the phase center of the upper radiating element.

According to yet another embodiment of the invention there is provided a method for providing a planar antenna for transmitting and/or receiving electromagnetic waves of at least one predefined frequency and a predefined polarization, the antenna having a dielectric substrate with upper and lower faces; at least one pair of substantially identical upper and lower radiating elements disposed on said upper and lower faces of the dielectric substrate; said radiating elements comprising radiating elements having first and second branches the method comprising:

determining the planar arrangement and the geometrical dimensions of said first and second branches in accordance with said predefined polarization and said at least one predefined frequency; and associating each of the radiating elements in the upper face with a corresponding radiating element in the lower face, such that the phase center of the lower radiating element substantially coincides with the phase center of the upper radiating element.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF SPECIFIC EMBODIMENTS OF THE INVENTION

Figure 1:
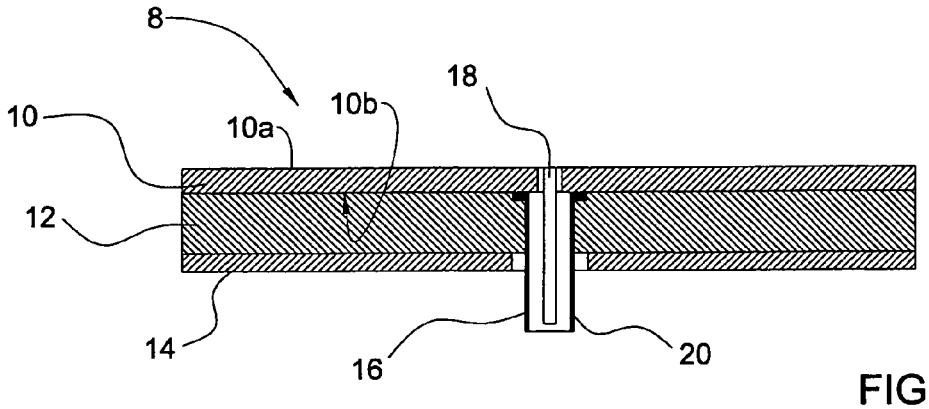
FIG. 1 is a cross-sectional view of a flat microwave antenna.

FIG. 1 is a general cross-sectional view of a flat microwave antenna 8 for high frequency microwave transmission (e.g. in various parts of 0.1–40 GHz range). The antenna 8 has a multilayer structure and comprises, inter alia, at least one PCB (Printed Circuit Board) 10 made of a dielectric material, e.g. PTFE Glass fiber type RT/duroid™ 5880 commercially available from Rogers Corporation, Ariz., USA, having relative permittivity $\epsilon_r$=2.2. The PCB 10 has two faces, 10*a* (upper face) and 10*b* (lower face) on which radiating elements (not shown in FIG. 1), made of an electrically conductive material, are disposed. The antenna 8 further comprises spacer layer 12 made of a low relative permittivity (e.g. foam, typically having $\epsilon_r$=1.05, air, having $\epsilon_r$=1.00) and a ground plate 14, typically made of a metallic material. Additional layers (not shown in FIG. 1) can also be used, as known in the field of antennas, such as a mounting plate, a polarizer layer, a box, etc. Discrete spacers can be used instead of spacer layer 12. Electrical coaxial connector 16 having pin 18 and sleeve 20 is used to feed the antenna. Note that the invention is not bound by the general structure of a planar antenna as exemplified in FIG. 1. For example, antenna 10 may be a conformal antenna, which conforms to a surface whose shape is determined by considerations other than electromagnetic, for example, aerodynamic or hydrodynamic.

Figure 2:
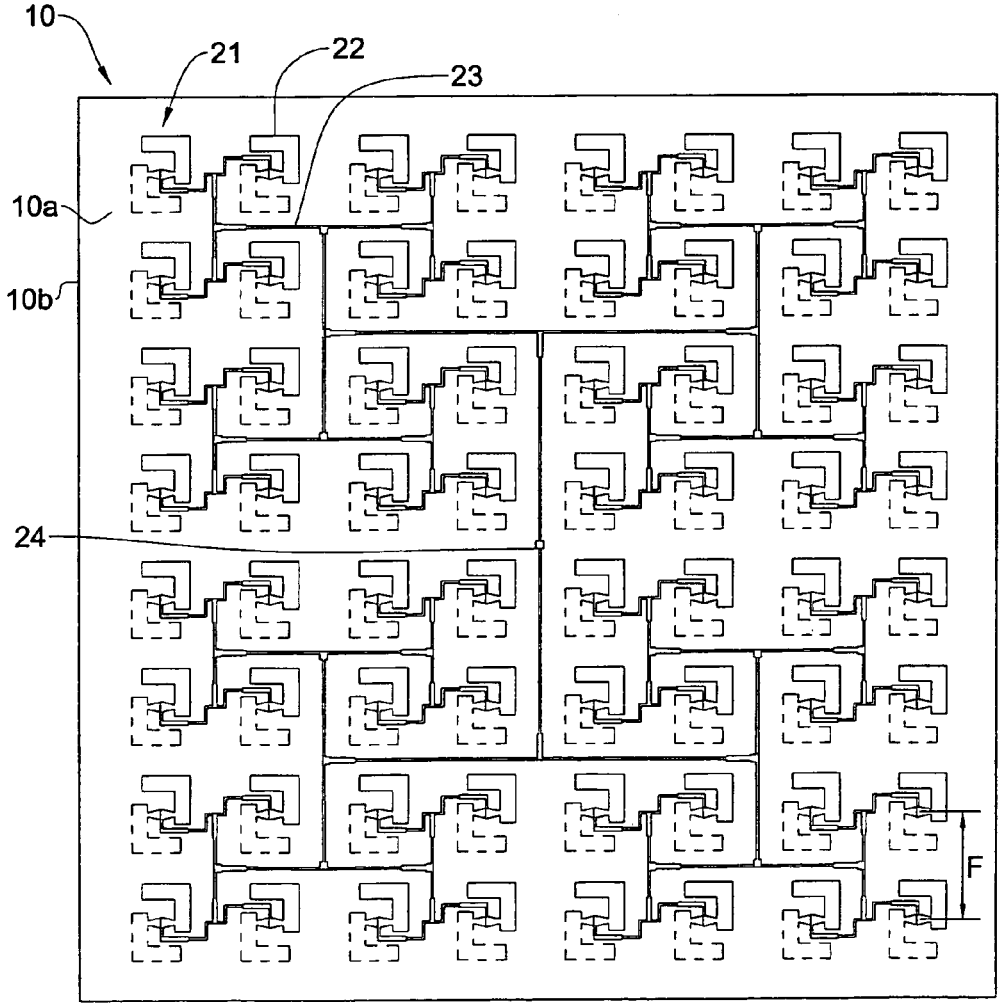
FIG. 2 is a top view of an antenna according to an embodiment of the invention.

FIG. 2 is a top view of the upper face 10*a* of the PCB 10 of the antenna 8 according to an embodiment of the invention, suitable for circular polarization. As shown in FIG. 2 in an exemplary manner, a plurality of radiating elements 21 is disposed in a specific configuration on face 10*a*. The radiating elements 21 are substantially identical and each comprises a bend-shaped element 22 and a co-planar transmission line 23 (both marked in FIG. 2 in full lines). A plurality of substantially identical radiating elements 21 is disposed on face 10*b*. Each of the radiating elements 21 disposed on face 10*a* is paired with a corresponding radiating element disposed on face 10*b* in a complementary manner that will be discussed in detail further below. The transmission lines of the paired radiating elements substantially overlay each other (the so-called "twin line" configuration) and thus the transmission lines 23 disposed on face 10*b* are not shown in FIG. 2. The bend-shaped elements 22 disposed on face 10*b* are marked in dashed line. The radiating elements on both faces are disposed in a substantially symmetrical manner around the feed structures 16, 18 and 20. The use of "twin line" configuration as well as the symmetrical positioning of the elements around the feed structures ensures the same input impedance of all radiating elements and balanced distribution of energy throughout the array.

In the non-limiting example of FIG. 2, the antenna comprises an array of 8×8 pairs of radiating elements. Note that the invention is not limited by this specific example and many other array configurations are possible, as the case may be and typically, the number of pairs of radiating elements is set to provide a certain desired gain. Note that the present invention can be embodied by utilizing only one pair of radiating elements. Also, note that the invention is not bound by the specific layout and configuration of the radiating elements as exemplified in FIG. 2.

Figure 3A:
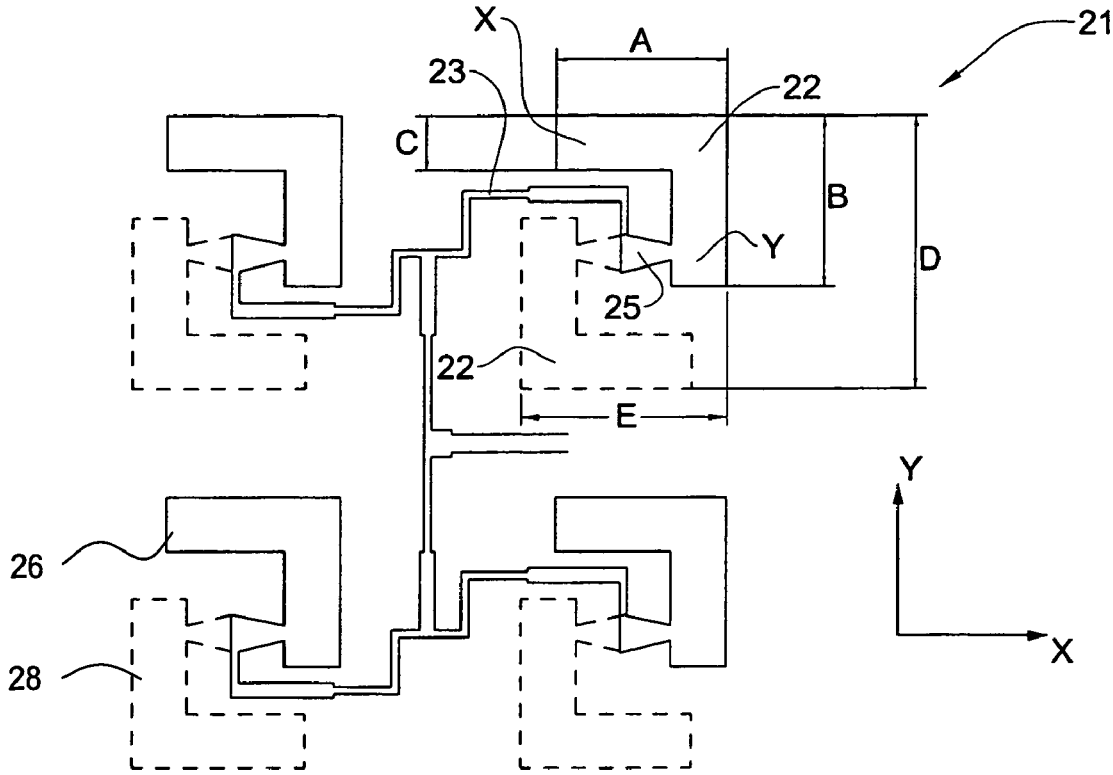
FIGS. 3*a*–3*b* are schematic illustrations of the structure of an element of the antenna of FIG. 2, from respectively, top and side views.
Figure 3B:
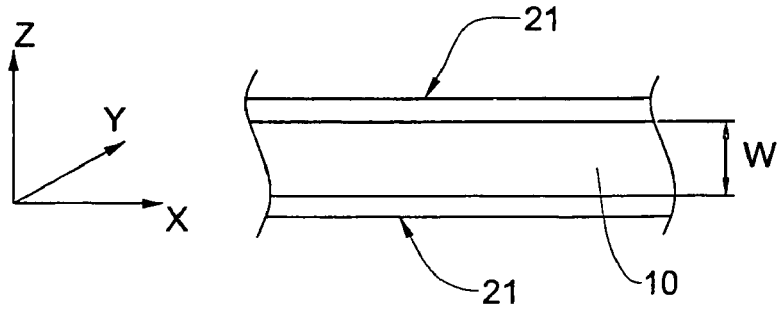

FIGS. 3*a*–3*b* illustrate schematically in greater detail the structure of paired radiating elements 21 of the antenna of FIG. 2, suitable for circular polarization in the frequency range of 8–9 GHz, from top and side views, respectively. Same elements are given same reference numbers. As shown in FIG. 3*a*, each of the radiating elements 21 comprises a bend-shaped element 22 connected to a transmission line 23 via feed point 25. As will be explained in greater detail further below, each of the radiating elements 21 is designed to be capable of radiating electromagnetic waves of a circular polarization, and the paired elements 21 are aligned with respect to each other in a relatively compact spatial arrangement, in a predefined manner, such that high level of antenna performance, e.g. gain up to 3 dB, is achieved, comparing to a prior art antenna with the same number of radiating elements having substantially the same geometrical dimensions. Thus, each pair of the substantially identical upper and lower radiating elements disposed on the upper and lower faces yields gain increase in the range of 1 dB to 3 dB and provides gain in the range of 6 dB to 9 dB and more (this is demonstrated e.g. in FIG. 5*a*).

The following is a description of the design of a single radiating element in the circular polarization configuration, in accordance with an embodiment of the invention. In the following example, the PCB material is having relative permittivity $\epsilon_r$=2.2 and width w=0.5 mm. Note that the invention is not bound by the following example.

As demonstrated in the non-limiting example of FIG. 3*a*, the antenna operates in a frequency of 8 GHz (this being the desired operating center frequency) and an L-shaped element 22 is used, having orthogonal branches X and Y disposed on the plane of the PCB 10. The geometrical dimensions of the L-shaped branches are as follows:

The lengths A and B of the X and Y branches are substantially identical and are defined by the following equation:

$$A, B=K_1\lambda_0 \quad [1]$$

Wherein $K_1$ is in the range of 0.3 to 0.35, e.g. $K_1$=0.33, and wherein $\lambda_0$ is the wavelength of the operating frequency in air. Thus, in the above mentioned operating frequency (8 GHz), A and B equal 12.5 mm.

The width C of the X and Y branches is defined as follows:

$$C=K_2\lambda_0 \quad [2]$$

Wherein $K_2$ is in the range of 0.10 to 0.20, e.g. $K_2$=0.106. In the example of FIG. 3*a* (operating frequency of 8 GHz), C equals 4 mm.

The feed point 25 is connected to one of the branches, the Y branch in the example of FIG. 3*a*. The location of the connection determines the delay between the current components propagating along the X and Y branches and is set to generate a phase delay of 90° between the components in order to provide circular polarization.

Figure 4A:
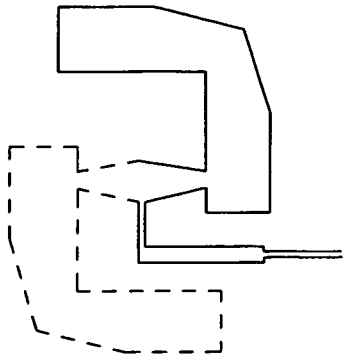
FIGS. 4*a*–4*d* are schematic illustrations of other structure of elements of the antenna of FIG. 2, in accordance with few other embodiments of the invention.
Figure 4B:
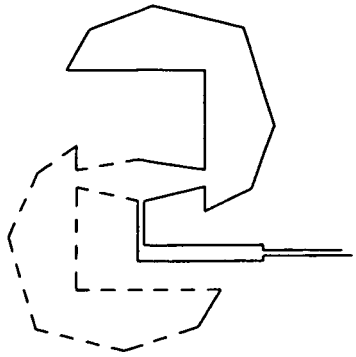
Figure 4C:
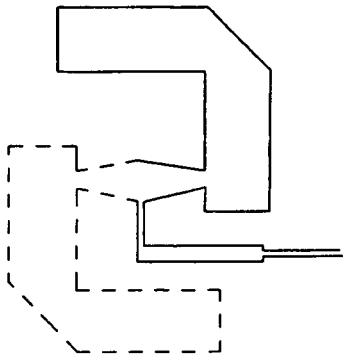
Figure 4D:
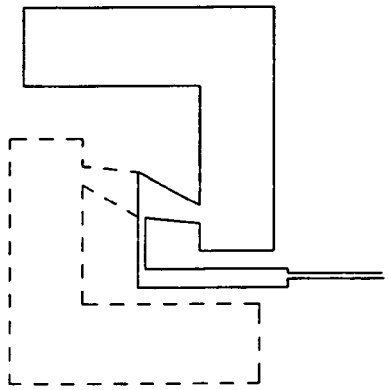

It should be noted that the invention is not limited by the specific example of the radiating element 21 as shown in FIG. 3*a*, and many others are possible, for example the elements illustrated in FIGS. 4*a*–4*b*, each having a substantial bend-shape. Note that the shape of the bend-shaped elements need not have straight-line contour, and any version of bend-shape element can be used, including a smooth shape.

According to an embodiment of the present invention, the radiating element is configured for generating electromagnetic field with circular polarization and for that purpose it has a substantially L-shape with first and second branches and a feed point located on said second branch, such that the electric current generated in the second branch is phase delayed in 90° with respect to the electric current generated in the first branch.

Having describing the design of a single radiating element there follows a description of the design of a paired radiating element in the circular polarization configuration, according to an embodiment of the invention:

As mentioned before, the paired elements 21 disposed on both the upper and lower faces of the PCB 10 are oppositely aligned in a relatively compact space, in a complementary manner, such that the phase centers of the upper and lower elements substantially coincide, yielding high level of antenna performance. According to an embodiment of the invention, the upper and lower elements are oppositely and adjacently aligned in the following manner:

Length D between the X branch of said upper radiating element and the X branch of said lower radiating element, and the length E between the Y branch of said upper radiating element and the Y branch of said lower radiating element, are defined by the following equations:

$$D=K_3\lambda_0 \quad [3]$$

$$E=K_4\lambda_0 \quad [4]$$

Wherein $K_3$ and $K_4$ are in the range of 0.3 to 0.6, e.g. $K_3$ and $K_4$ equal 0.41 $\lambda_0$. Note that D and E need not be identical. Also note that upper and lower radiating elements need not be in full symmetry with each other. Note that D and E values other than the above specified values can be used. For example, in the case D or E exceeds 0.6$\lambda_0$, the gain of the antenna may increase due to the increase in the equivalent surface of the antenna. However the axial ratio (the measure of the antenna circularity on its axis of symmetry) is increased.

According to the present invention and as illustrated in FIGS. 2 and 3*a*, the phase centers of the upper and lower radiating elements substantially coincide with each other. In the case the paired elements are arranged in an array (as shown in FIG. 2), a length F between the phase centers of adjacent pairs must be kept at a certain range as follows:

$$0.5\lambda_0<F<1\lambda_0 \quad [5]$$

In the above discussion with reference to FIGS. 2 and 3*a*–3*b*, the relative alignment of the paired elements 21 is presented in two dimensions only, namely with respect to the X and Y axis that define the plane of the PCB 10. However, the relative alignment of the paired element 21 is actually defined in three-dimensions, i.e. onto the plane of the PCB 10 and also along the orthogonal Z axis. Due to the very small width w of the PCB 10 (as shown in FIG. 3*b*), typically about 0.1–0.5 mm, it is possible to disregard the relative alignment considerations along the Z axis and to define the relative alignment of the paired elements in two-dimensions only. The width w of the PCB 10 needs to be very small with respect to $\lambda$, the wavelength corresponding to the operating frequency of the antenna, e.g. less than 0.05$\lambda$ or 0.1$\lambda$ or more, otherwise the relative alignment of the paired element should be defined in three dimensions.

The phase center of an antenna can be determined by measurements, computed simulations, and calculations. As discussed in "Antenna Handbook, Volume II Antenna Theory", ed. Y. T. Lo, Van Nostrand Reinhold, N.Y., in chapter 8, the analytical formulations for locating the phase center of an antenna typically exist for only a limited number of antenna configurations. Experimental techniques are known in the art for locating the phase center of an antenna, as well as simulation tools such as the CST Microwave Studio™ software commercially available from CST Computer Simulation Technology GmbH, Germany.

FIGS. 5*a*–5*e* illustrate simulated characteristics of a pair of radiating elements according to an embodiment of the invention, in the circular polarization configuration shown in FIG. 3*a*, relating to operating frequencies in the range of 8–9 GHz, as follows.

Figure 5A:
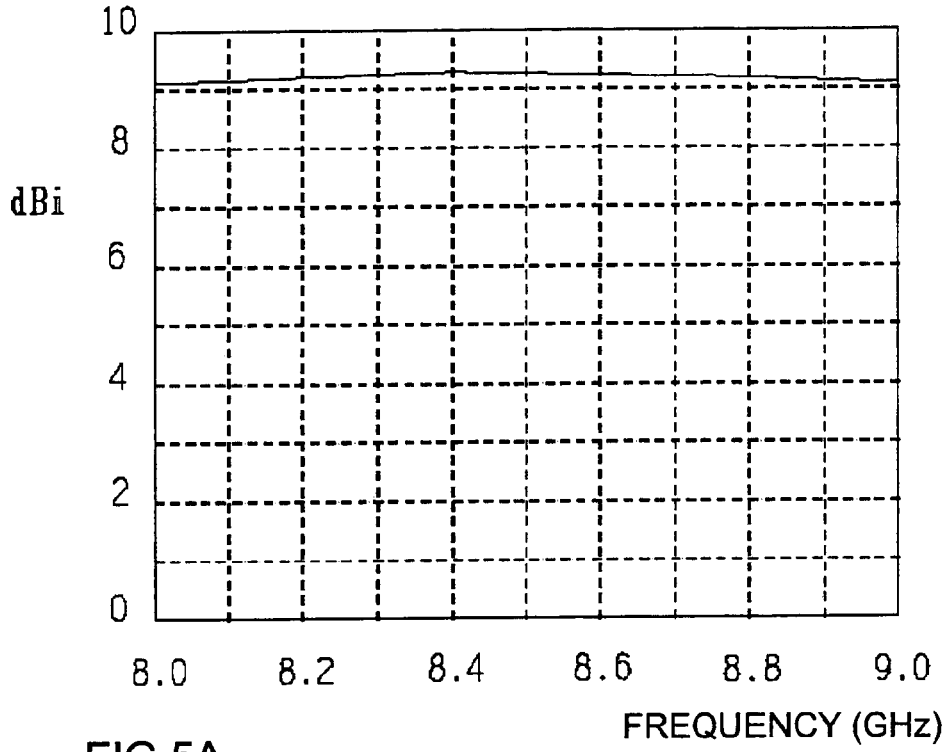
FIGS. 5*a*–5*e* illustrate simulated characteristics of an antenna element according to an embodiment of the invention.
Figure 5B:
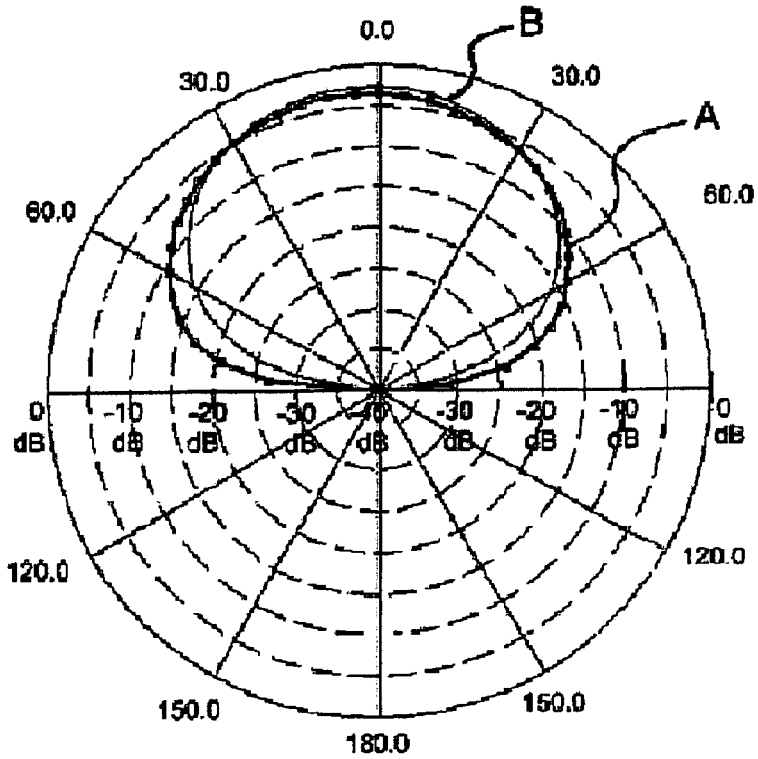
Figure 5C:
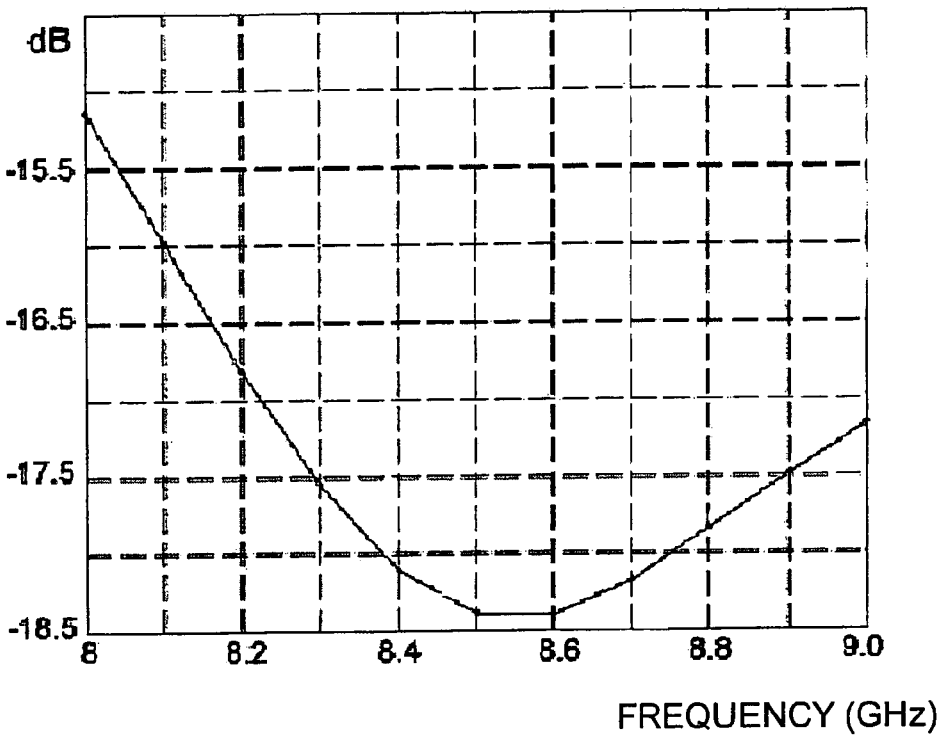
Figure 5D:
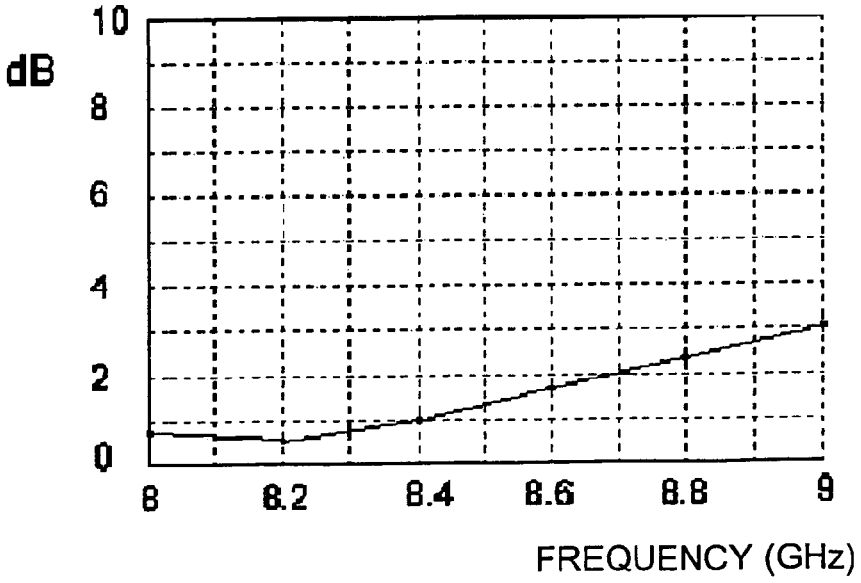
Figure 5E:
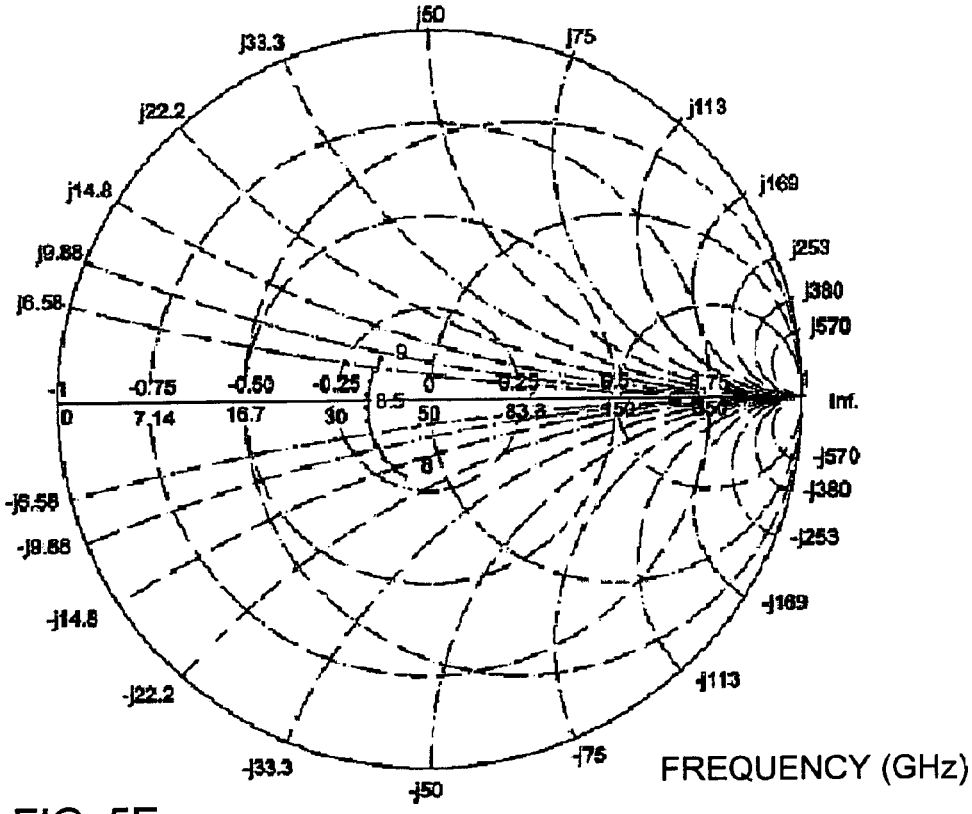

FIG. 5*a* shows the gain of a single pair of radiating elements. Note that typically the characterizing gain of a prior art radiating elements having substantially the same geometrical dimensions as described above with reference to FIG. 3*a* is substantially up to 6 dB. FIG. 5*b* shows the simulated radiation pattern of the pair of radiating elements. Graph A represents the component $E_{phi}$ for phi=0° and graph B represents the component $E_{theta}$ for phi=0°. FIG. 5*c* shows the return loss in dB (the so-called $S_{11}$). FIG. 5*d* shows the axial ratio at (0,0)° (the so-called Broad side direction). FIG. 5*e* shows the so-called "Smith chart" of the input impedance.

According to yet another embodiment of the invention there is provided an antenna suitable for linear polarization. There follows a description of the design of a single radiating element as well as the paired radiating elements in the linear polarization configuration.

Figure 6:
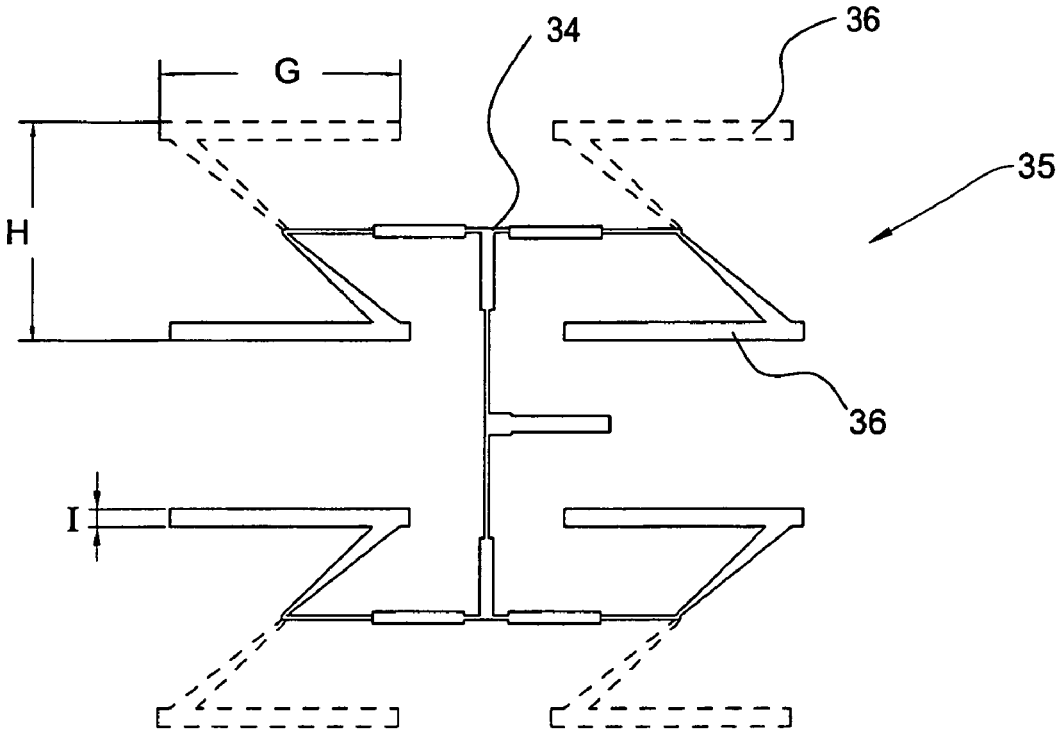
FIG. 6 is a schematic illustration of the structure of an element of an antenna according to another embodiment of the invention.

Reference is now made to FIG. 6, illustrating the structure of paired radiating elements 35 of an antenna according to an embodiment of the invention suited for linear polarization (horizontal or vertical, as the case may be) in operating frequency of 8 GHz. In the case of linear polarization, each of the upper and lower radiating elements 36 has bend-shaped elements having the shape of two-branches creating an acute angle between the branches. According to an embodiment of the invention the upper and lower radiating elements are relatively aligned such that the shape "Z" or "S" (or substantially such shape) is created, as shown in FIG. 6.

According to an embodiment of the invention, the radiating elements of the linear polarization configuration comprises bend-shaped elements having first and second branches arranged in an acute angle with respect to each other. The upper and lower radiating elements are arranged in a substantially symmetrical arrangement on both faces of the PCB, such that the first branches of the upper and lower elements are in parallel; and the electrical length of each of said first branches is about $0.5\lambda_0$, wherein $\lambda_0$ is the wavelength of said predefined frequency in air. In other words, each of the first branches of the upper and lower radiating elements, by itself, operates as a radiating element in linear polarization.

In the following example, the PCB material is having relative permittivity $\epsilon_r$=2.2 and width w=0.5 mm. Note that the invention is not bound by the following example. The geometrical dimensions of the acute-angled branches according to the following example are as follows:

The length G of the first branch is defined by the following equation:

$$G=K_5\lambda_0 \quad [7]$$

Wherein $K_5$ is in the range of 0.3 to 0.4, e.g. $K_5$=0.36, and wherein $\lambda_0$ is the wavelength of the operating frequency in air. Thus, in the above-mentioned example (operating frequency of 8 GHz), G equals 13.5 mm.

The length H between the first branches of the upper and lower elements is defined by the following equation:

$$H=K_6\lambda_0 \quad [8]$$

Wherein $K_6$ is in the range of 0.3 to 0.35, e.g. $K_6$=0.32, and wherein $\lambda_0$ is the wavelength of the operating frequency in air. Thus, in the above mentioned operating frequency (8 GHz), H equals 12 mm.

The width I of the radiating element is defined by the following equation:

$$I=K_7\lambda_0 \quad [9]$$

Wherein $K_7$ is in the range of 0.015 to 0.025, e.g. $K_7$=0.02, and wherein $\lambda_0$ is the wavelength of the operating frequency in air. Thus, in the above-mentioned operating frequency (8 GHz), I equals 1 mm. note that the invention is not limited by the specific example of FIG. 6.

Figure 7A:
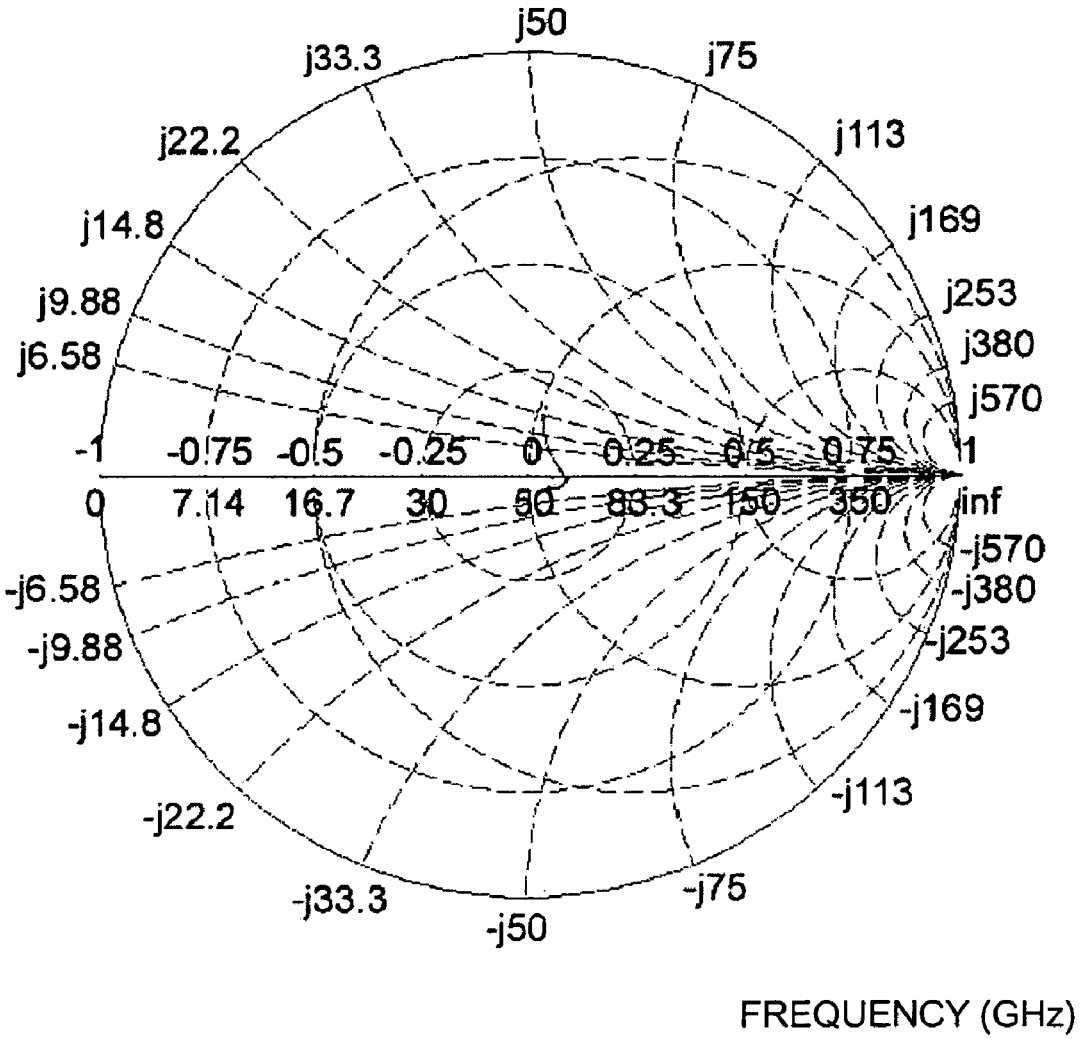
FIGS. 7*a*–7*c* illustrate simulated characteristics of an antenna element according to another embodiment of the invention.
Figure 7B:
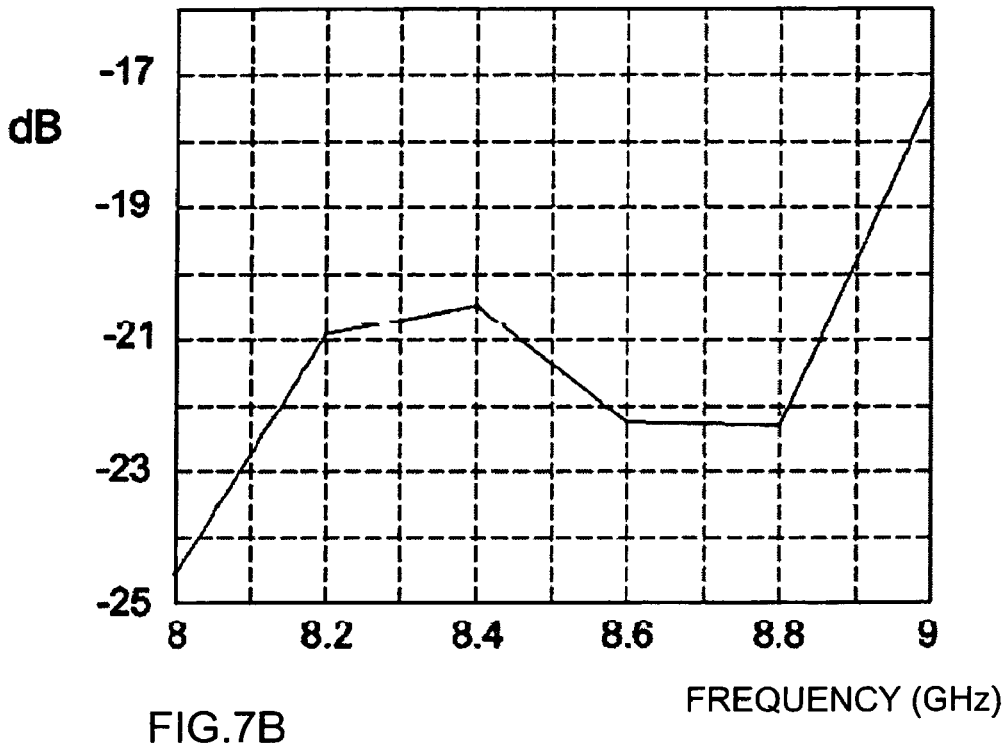
Figure 7C:
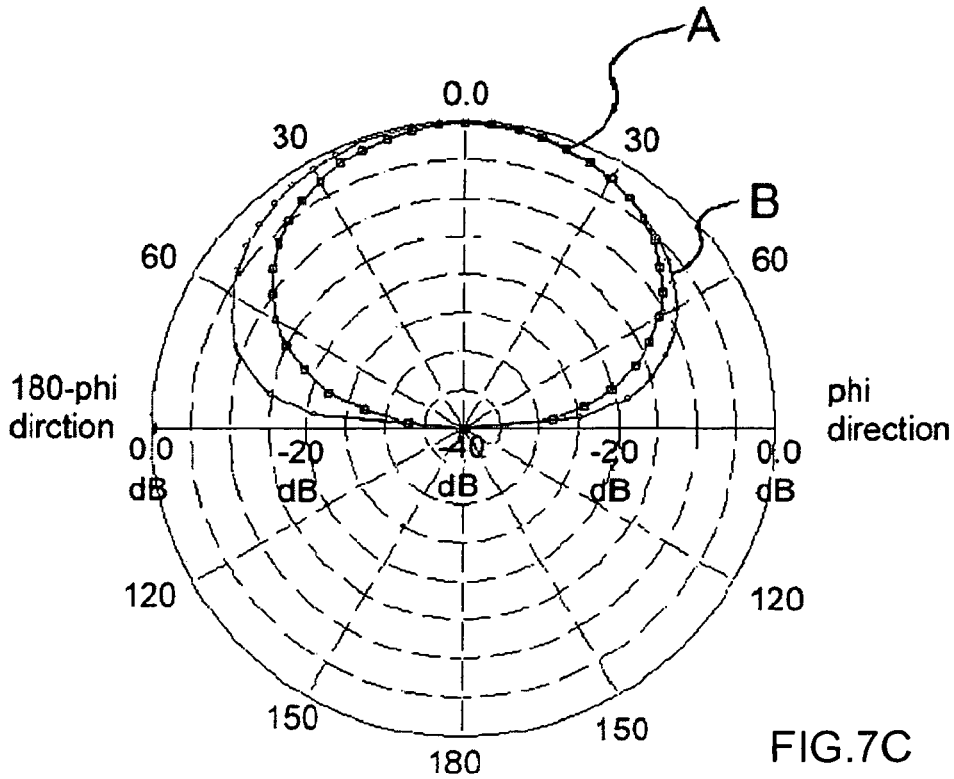

FIGS. 7*a*–7*c* illustrate simulated characteristics of an antenna paired element according to the embodiment of the invention shown in FIG. 6, in the operating frequency range of 8–9 GHz, as follows. FIG. 7*a* shows simulated input impedance of one paired element (the so called "Smith chart"). FIG. 7*b* shows the return loss in dB (the so-called $S_{11}$), of one paired element, in the frequency range of 8–9 GHz, and FIG. 7*c* shows the polar elevation pattern of the paired element at the frequency of 8.2 GHz. Graph A represents the component $E_{theta}$ for phi=90° and graph B represents the component $E_{phi}$ for phi=0°.

The invention was described in details with reference to a planar configuration, in which the radiating elements are disposed onto both faces of a planar support. It should be noted that the invention is not limited by the above-described planar configuration and other arrangements are possible within the scope of the invention. For example, the invention can be implemented as a conformal antenna, which conforms to a surface whose shape is determined by considerations other than electromagnetic, for example, aerodynamic or hydrodynamic, or other non-planar configurations.

The invention was described in detail with reference to the operating frequencies falling within the range of 8–9 GHz. It should be noted that the invention is not limited by this specific example, and is suitable to operate in a variety of frequencies, with the necessary modifications and alterations, e.g. change of the operating frequency would result in change in the geometrical dimensions of the radiating elements and their respective planar layout and arrangement. The invention was described with reference to a printed configuration (utilizing a PCB), however it should be noted that the invention is not limited by this configuration. It should also be noted that in the range of relatively lower frequencies (e.g. 1 GHz and less), $\lambda$ equals 30 cm or more, thus allowing the use radiating elements made of metal, as well as the use of air spacers, foam layers, etc.

The invention was described with reference to a single PCB configuration, in which the PCB have the radiating elements disposed on both its faces. It should be noted that the invention can be implemented in another configuration, in which two PCBs and more are adjacently used, each having the radiating elements disposed on one or both its faces, such that the phase centers of adjacent radiating elements substantially coincide.

The present invention has been described with a certain degree of particularity, but those versed in the art will readily appreciate that various alterations and modifications may be carried out without departing from the scope of the following claims:

What is claimed is:

1. A microwave antenna for transmitting and/or receiving electromagnetic waves of at least one predefined frequency and a predefined polarization, the antenna comprising a support with upper and lower faces and at least one pair of substantially identical upper and lower radiating elements disposed on said upper and lower faces; each radiating element is capable of transmitting and/or receiving electromagnetic waves of said predefined polarization with a phase center located at a predefined position; in each pair, the phase center of the lower radiating element substantially coincides with the phase center of the upper radiating element.

2. An antenna according to claim 1 wherein said support is conformal.

3. An antenna according to claim 1 wherein said support is substantially planar.

4. An antenna according to claim 1 wherein said predefined polarization is a circular polarization, and wherein each of said radiating elements is capable of radiating electromagnetic waves of a circular polarization.

5. An antenna according to claim 4 wherein said radiating elements comprising bend-shaped elements.

6. An antenna according to claim 4 wherein said bend-shape is an L-shape.

7. An antenna according to claim 6 wherein said L-shape having first and second branches and a feed point located on said second branch such that the electric current generated in the second branch is phase delayed in 90° with respect to the electric current generated in the first branch.

8. An antenna according to claim 7 wherein said L-shape having an X branch and an orthogonal Y branch, and wherein:

the length A of the X branch and the length B of the Y branch are substantially identical and depend on said predefined frequency according to the relation: A, $B=K_1 \lambda_0$, $K_1$ is in the range of 0.3 to 0.35;

the widths C of the X and Y branches depend on said predefined frequency according to the relation: $C=K_2 \lambda_0$, $K_2$ is in the range of 0.10 to 0.20;

the length D between the X branch of said upper radiating element and the X branch of said lower radiating element depend on said predefined frequency according to the relation: $D=K_3 \lambda_0$, $K_3$ is in the range of 0.3 to 0.6;

the length E between the Y branch of said upper radiating element and the Y branch of said lower radiating element depend on said predefined frequency according to the relation: $E=K_4 \lambda_0$, $K_4$ is in the range of 0.3 to 0.6;

wherein $\lambda_0$ is the wavelength of said predefined frequency in air.

9. An antenna according to claim 1 wherein said pair of substantially identical upper and lower radiating elements disposed on said upper and lower faces yields gain increase in the range of 1 dB–3 dB.

10. An antenna for transmitting and/or receiving electromagnetic waves of at least one predefined frequency and a predefined polarization, the antenna comprising a multi-layered substrate structure having a dielectric substrate with upper and lower faces; at least one pair of substantially identical upper and lower radiating elements disposed on said upper and lower faces of the dielectric substrate; each radiating element is capable of transmitting and/or receiving electromagnetic waves of said predefined polarization with a phase center located at a predefined position; each radiating element comprising a radiating element and a transmission line, the geometrical dimensions of which depend on said predefined frequency; in each pair:

the transmission lines of the upper and lower elements overlay each other;

the radiating elements of the upper and lower elements are located oppositely to each other with respect to a plane perpendicular to the plane of the dielectric substrate, such that the phase center of the lower radiating element substantially coincides with the phase center of the upper radiating element.

11. An antenna according to claim 10 wherein said multi-layered substrate structure is conformal.

12. An antenna according to claim 10 wherein said multi-layered substrate structure is substantially planar.

13. An antenna according to claim 10 wherein said predefined polarization is a circular polarization, and wherein each of said radiating elements is capable of radiating electromagnetic waves of a circular polarization.

14. An antenna according to claim 13 wherein said radiating elements comprising radiating elements having a substantial L-shape.

15. An antenna according to claim 13 wherein said radiating elements comprising radiating elements having an L-shape.

16. An antenna according to claim 15 wherein said L-shape having first and second branches and a feed point located on said second branch such that the electric current generated in the second branch is phase delayed at 90° with respect to the electric current generated in the first branch.

17. An antenna according to claim 10 wherein said pair of substantially identical upper and lower radiating elements disposed on said upper and lower faces yields gain increase in the range of 1 dB–3 dB.

18. A method for providing a planar antenna for transmitting and/or receiving electromagnetic waves of at least one predefined frequency and a predefined polarization, the antenna having a dielectric substrate with upper and lower faces; at least one pair of substantially identical upper and lower radiating elements disposed on said upper and lower faces of the dielectric substrate; each radiating element is capable of transmitting and/or receiving electromagnetic waves of said predefined polarization with a phase center located at a predefined position; said radiating elements comprising first and second radiating element branches, the method comprising:

determining the planar arrangement and the geometrical dimensions of said first and second radiating element branches in accordance with said predefined polarization and said at least one predefined frequency;

associating each of the radiating elements in the upper face with a corresponding radiating element in the lower face, such that the phase center of the lower radiating element substantially coincides with the phase center of the upper radiating element.

19. A method according to claim 18 wherein said predefined polarization is a circular polarization and wherein each of said radiating elements is capable of radiating electromagnetic waves of a circular polarization.

20. A method according to claim 19 wherein said radiating elements comprise radiating elements having a bend-shape.

21. A method according to claim 20 wherein said bend-shape is an L-shape.

22. A method according to claim 21 wherein said L-shape having first and second branches and a feed point located on said second branch such that the electric current generated in the second branch is phase delayed at 90° with respect to the electric current generated in the first branch.

23. A method according to claim 21 wherein said L-shape having an X branch and an orthogonal Y branch, and wherein:

the length A of the X branch and the length B of the Y branch are substantially identical and depend on said predefined frequency according to the relation: A, $B=K_1 \lambda_0$, $K_1$ is in the range of 0.3 to 0.35;

the widths C of the X and Y branches depend on said predefined frequency according to the relation: $C=K_2 \lambda_0$, $K_2$ is in the range of 0.10 to 0.20;

the length D between the X branch of said upper radiating element and the X branch of said lower radiating element depend on said predefined frequency according to the relation: $D=K_3 \lambda_0$, $K_3$ is in the range of 0.3 to 0.6;

the length E between the Y branch of said upper radiating element and the Y branch of said lower radiating element depend on said predefined frequency according to the relation: $E=K_4 \lambda_0$, $K_4$ is in the range of 0.3 to 0.6;

wherein $\lambda_0$ is the wavelength of said predefined frequency in air.

* * * * *